United States Patent [19]

Kelly et al.

[11] 4,322,101

[45] Mar. 30, 1982

[54] ADJUSTABLE SPRING LATCH FOR COKE OVEN DOORS OR THE LIKE

[75] Inventors: Calvin E. Kelly, Murrysville; Thomas E. Nicely, Delmont Borough, both of Pa.

[73] Assignee: United States Steel Corporation, Pittsburgh, Pa.

[21] Appl. No.: 92,615

[22] Filed: Nov. 8, 1979

[51] Int. Cl.[3] ..... E05C 3/04

[52] U.S. Cl. ..... 292/260; 292/1

[58] Field of Search ..... 70/432; 85/62; 292/1, 292/241, 251, 260, 259

[56] References Cited

U.S. PATENT DOCUMENTS

| | | | |
|---|---|---|---|
| 1,973,228 | 9/1934 | Schott | 292/260 X |
| 2,798,752 | 7/1957 | Doll | 292/260 |
| 3,493,256 | 2/1970 | Ramler | 70/432 X |
| 3,886,840 | 6/1975 | Bossler | 85/62 |

*Primary Examiner*—Richard E. Moore

*Attorney, Agent, or Firm*—Walter P. Wood; W. F. Riesmeyer

[57] ABSTRACT

An adjustable spring latch for doors of coke ovens or the like. The latch includes springs which urge the door into tight engagement with the jamb. The force exerted by the springs can be adjusted by turning a spindle. The latch also includes sight pins which afford a visual indication of the force exerted by the springs.

5 Claims, 5 Drawing Figures

ADJUSTABLE SPRING LATCH FOR COKE OVEN DOORS OR THE LIKE

This invention relates to an improved adjustable spring latch for doors of coke ovens or the like.

Conventional latching mechanisms for coke oven doors include rotatable latch bars mounted on spindles carried by the door. The latch bars engage hooks carried by the jamb at opposite sides of the door to hold the door in closed position. In a spring-type latch, the spindle also carries springs which urge the door into tight engagement with the jamb and thus aid in preventing gases, etc. from leaking from the oven. The force which the springs exert on the door should be carefully controlled. If the force is too low, the springs may not hold the door tightly enough to prevent leakage, while excessive force may damage the parts. Even though the spring force is adjusted properly initially, the springs tend to become relaxed in service. Hence there usually is provision for subsequent adjustment of the spring force. Reference can be made to Doll U.S. Pat. No. 2,798,752, Peterson U.S. Pat. No. 3,505,174, or Dahl U.S. Pat. No. 4,061,382 for exemplary showings of coke oven doors equipped with spring latches.

An object of our invention is to provide an improved spring latch which is more easily adjusted to correct the force exerted by the springs than latches used heretofore.

A further object is to provide an adjustable spring latch which has visible indicator means enabling an operator to know at a glance whether adjustments are needed.

A more specific object is to provide an improved adjustable spring latch which includes at least one sight pin projecting into a cooperating hole in a support plate fixed to the door body, the location of the end of the pin relative to the hole affording a visual indication of the force exerted by the springs.

Figure 1:
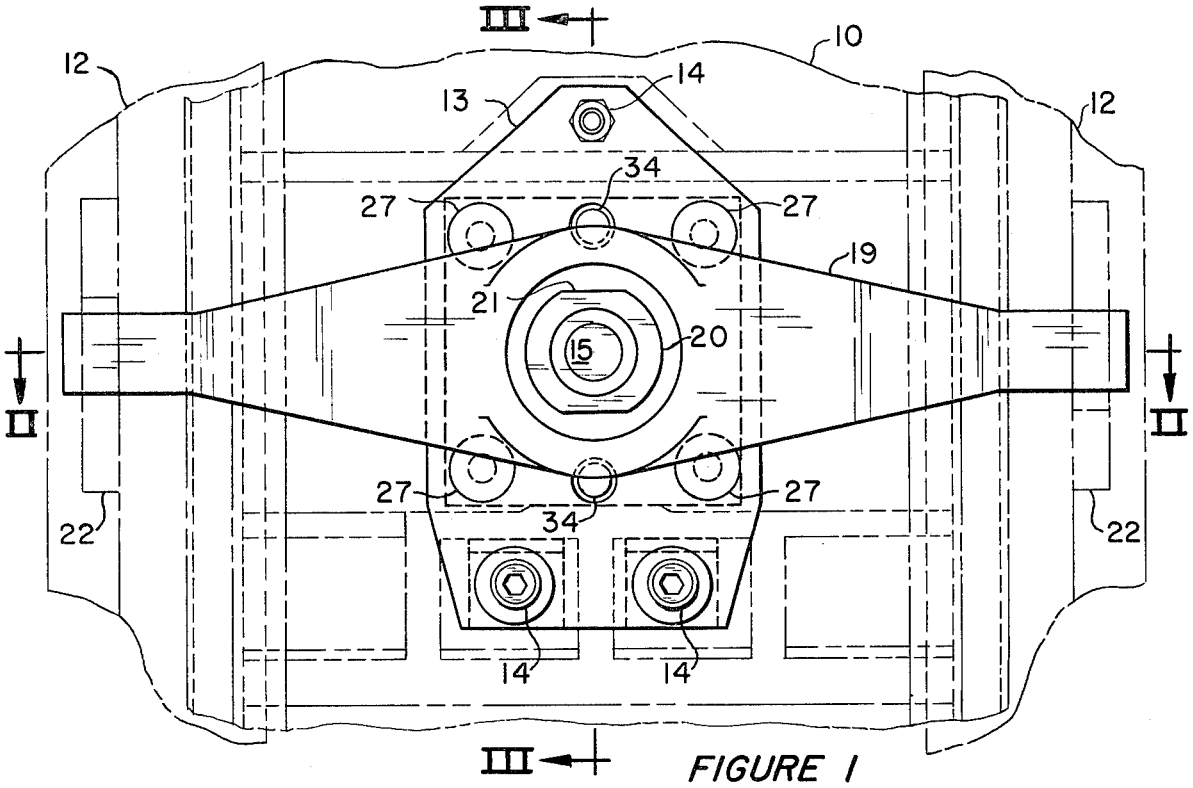
FIG. 1 is a front elevational view of a portion of a coke oven door and jamb equipped with an adjustable spring latch in accordance with our invention.
Figure 2:
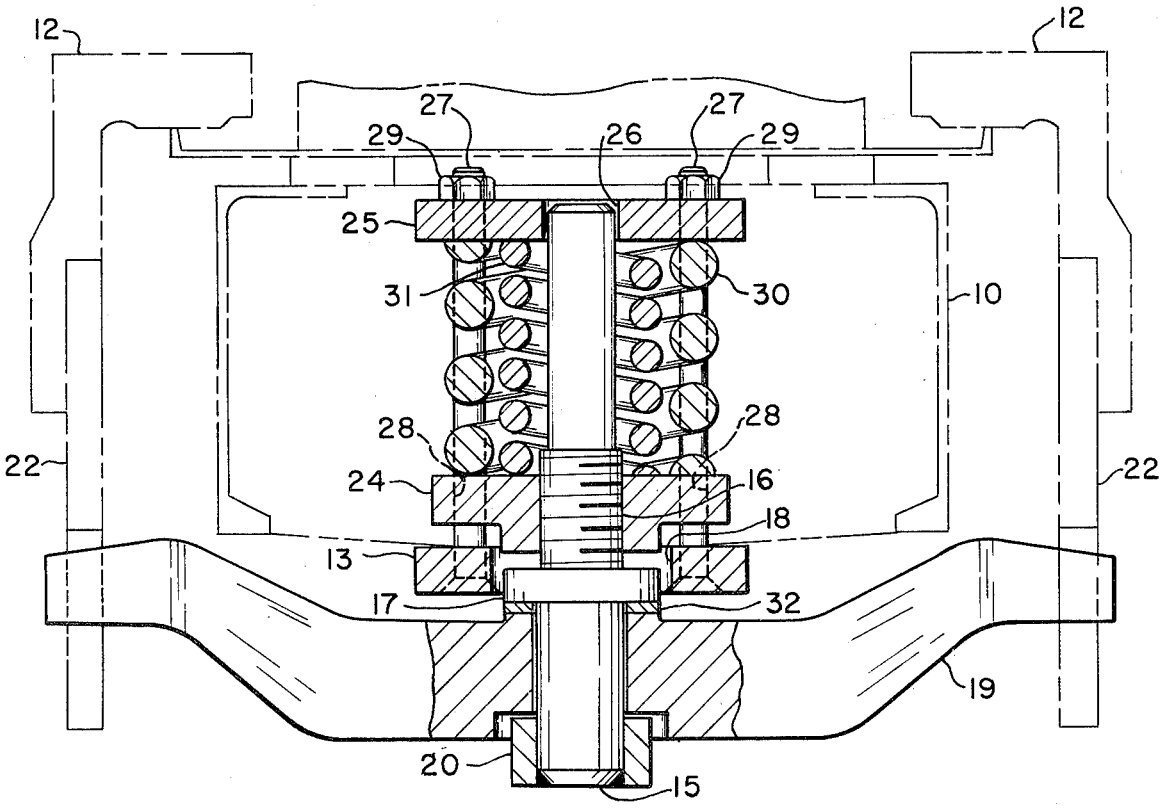
FIG. 2 is a horizontal sectional view on line II—II of FIG. 1.

The drawings show portions of a conventional coke oven door 10 and jamb 12. The door includes a support plate 13 fixed to the door body with bolts 14. A spindle 15, which has a threaded section 16 and an integral collar 17, extends through an opening 18 in the support plate 13. A latch bar 19 is rotatably mounted on spindle 15 outwardly of collar 17 and is retained thereon by another collar 20 fixed to the end of the spindle. The collar 20 has wrench flats 21. The latch bar is engageable with hooks 22 which project outwardly from the jamb 12 at opposite sides of the door for holding the door in closed position.

The latch mechanism of our invention includes spaced apart outer and inner pressure plates 24 and 25.

The outer plate 24 threadedly engages the threaded section 16 of the spindle. The inner plate has a hole 26 through which the inner end portion of the spindle projects. A plurality of bolts 27 extend from the support plate 13, pass loosely through oversize holes 28 in plate 24, and through plate 25 and carry nuts 29 at their inner end portions beyond plate 25. Thus bolts 27 rigidly connect the inner plate 25 with the support plate 13. Outer and inner compression springs 30 and 31 encircle the spindle and bear at opposite ends against the two pressure plates.

When the door 10 is closed, the springs 30 and 31 act through the rigid assembly of inner plate 25, bolts 27 and support plate 13 to urge the door inwardly into tight engagement with the jamb 12. The outer plate 24 acts as a fixed abutment in any one position of adjustment. The force exerted by the springs can be adjusted by engaging a wrench with the collar 20 and turning the spindle 15, thus moving the outer plate 24 translationally along the threaded section 16. If the threads are right-hand, turning the spindle counterclockwise compresses the springs and increases the force which they exert on the door, while turning the spindle clockwise relaxes the springs. Optionally, we may place a low-friction washer 32 or antifriction bearing on the spindle between the latch bar 19 and the collar 17 to prevent torque applied to the spindle from being transmitted to the latch bar, but this usually is not necessary.

Figure 3:
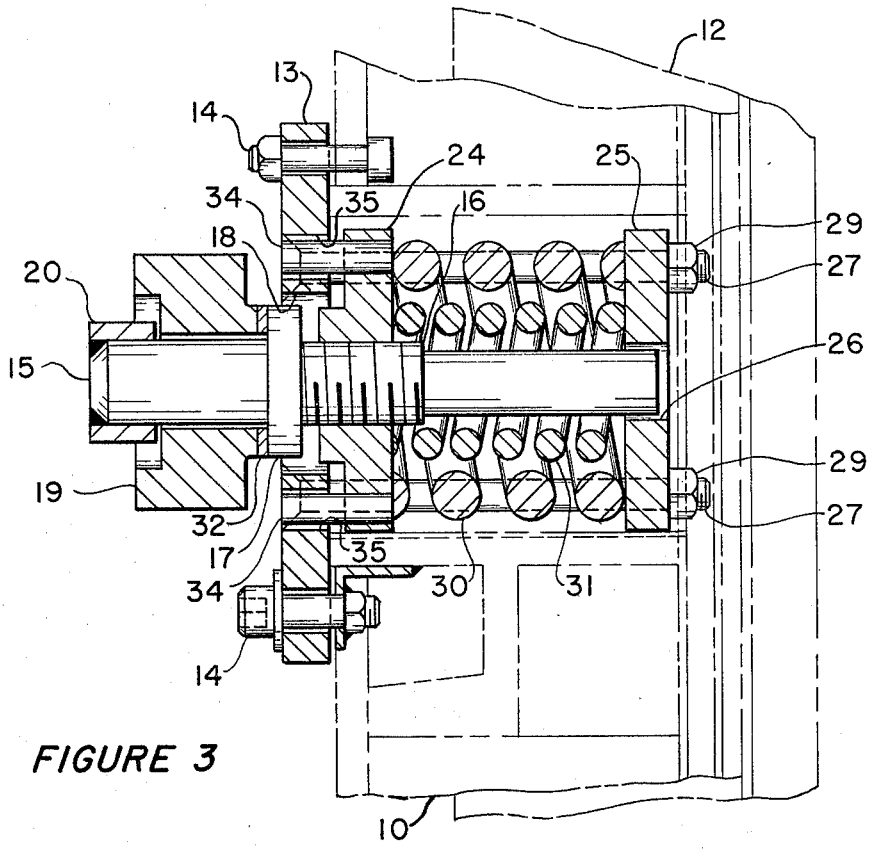
FIG. 3 is a vertical sectional view on line III—III of FIG. 1 showing the position of parts with the spring force adjusted properly.
Figure 4:
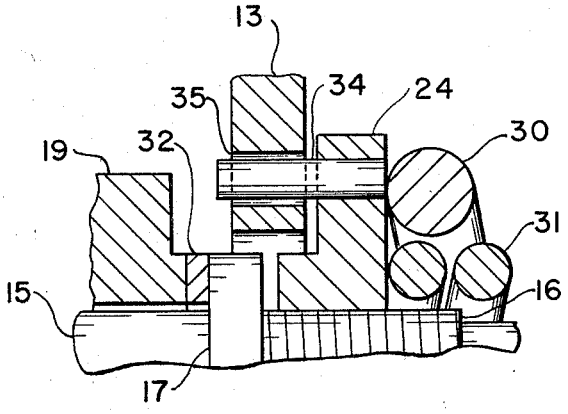
FIG. 4 is a fragmentary vertical sectional view similar to FIG. 3, but showing the position of parts with spring force too low.
Figure 5:
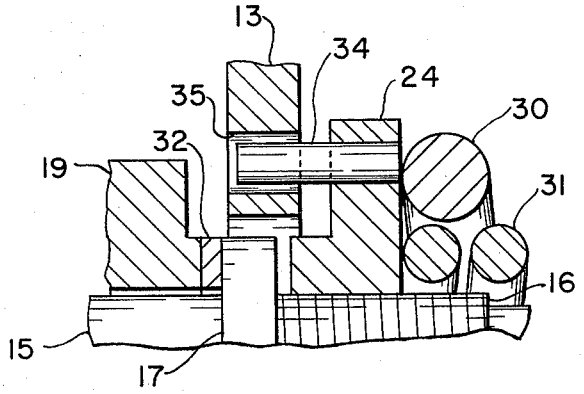
FIG. 5 is another fragmentary vertical sectional view similar to FIGS. 3 and 4, but showing the position of parts with excessive spring force.

We fix one or more sight pins 34 to the outer plate 24 for visually indicating the relative force exerted by the springs. The sight pins project outwardly from the plate into holes 35 in the support plate 13 where they are readily visible to the operator. Preferably, we coat the ends of the pins with a light colored heat resistant paint for better visibility. The pins are of a length such that, when the outer face of the support plate is flush with the ends of the exposed ends of the pins, as shown in FIG. 3, the springs 30 and 31 exert the proper force on the door. When the ends of the pins project beyond the support plate, as shown in FIG. 4, the force exerted by the springs is too low. When the ends of the pins do not reach the face of the support plate, as shown in FIG. 5, the force exerted by the springs is excessive. In either instance, the force can be corrected to the proper magnitude by turning the spindle as already described.

From the foregoing description, it is seen that our invention affords a spring latch which is simple in construction and easy to adjust. The sight pins afford a ready indication of the need for adjustment. For convenience, we describe the latch as applied to a coke oven door, but it is apparent it can be applied elsewhere; and the invention is not limited to use on coke ovens.

We claim:

1. The combination, with a door and a jamb adapted to be engaged by said door, of a spring latch mechanism comprising:

a spindle having a threaded portion on the length thereof, and extending axially in an outward direction from said door normal to the plane of said door and the jamb;

a latch bar rotatably mounted on said spindle;

means on said jamb with which said latch bar is engageable to hold said door in closed position;

an outer pressure plate threadedly engaging said spindle;

an inner pressure plate spaced from said outer pressure plate and rigidly connected to said door;

spring means acting between said pressure plates whereby the force exerted by said spring means on said pressure plates urges said door into engagement with said jamb;

the force exerted by said spring means being adjustable by turning said spindle to move said outer pressure plate translationally with respect to said door in a direction axially along said spindle;

mounting means secured to said door for (a) guiding slidable movement of the outer pressure plate and spindle in a direction normal to the plane of said door and jamb, and (b) preventing rotation of said outer plate on turning of said spindle; and means carried by said outer pressure plate for visually indicating by the relative position thereof with respect to an adjacent part of said mounting means, a measure of the force exerted by said spring means compared to a desired value thereof.

2. A combination as defined in claim 1 comprising antifriction means between said latch bar and said spindle to prevent torque applied to the spindle from being transmitted to the latch bar.

3. A combination as defined in claim 1 in which said force indicating means includes at least one sight pin carried by said outer pressure plate, and wherein said mounting means includes a plate having a hole for each pin into which said pin projects, the location of the end of said pin relative to said hole affording said measure of the force exerted by said spring means.

4. In a door adapted to engage a jamb bounding an opening in a coke oven, said door including a latch bar for engaging hook means extending outwardly from said jamb, spring means for urging said latch bar outwardly in a direction normal to the plane of said door and jamb, thus urging said door inwardly into engagement with said jamb, means mounting said spring means between said door and latch bar, means on said mounting means for abutting opposite ends of said spring in said normal direction, means for moving one of said abutting means translationally in said normal direction with respect to said door, thereby adjusting the force exerted by said spring on the latch bar, the improvement in said apparatus which comprises:

means carried by said movable spring abutting means for visually indicating by the relative position thereof with respect to an adjacent fixed reference part of said mounting means, a measure of the force exerted by said spring means compared to a desired value thereof.

5. The apparatus of claim 4 wherein said force indicating means carried by said abutting means includes at least one sight pin, and wherein said mounting means has a hole for each sight pin into which said sight pin projects, the location of said pin relative to said hole affording said measure of the force exerted by said spring means.

* * * * *